US006561393B1

(12) United States Patent
Cheng

(10) Patent No.: US 6,561,393 B1
(45) Date of Patent: May 13, 2003

(54) COLLAPSIBLE HAT AND METHOD OF COLLAPSING THE HAT

(76) Inventor: Peter S. C. Cheng, 99 Glencairn Street, Toronto, Ontario (CA), M4R 1M7

( * ) Notice: Subject to any disclaimer, the term of this patent is extended or adjusted under 35 U.S.C. 154(b) by 297 days.

(21) Appl. No.: 09/679,759

(22) Filed: Oct. 5, 2000

Related U.S. Application Data

(63) Continuation of application No. 09/267,822, filed on Mar. 12, 1999, now Pat. No. 6,216,277.

(51) Int. Cl.[7] ..... A42B 1/00
(52) U.S. Cl. ..... 223/171.03; 2/175.5
(58) Field of Search ..... 2/171.03, 175.5, 2/171, 175.4

(56) References Cited

U.S. PATENT DOCUMENTS

| | | | | |
|---|---|---|---|---|
| 2,495,041 A | | 1/1950 | Weiss | |
| 2,678,448 A | | 5/1954 | Rosenzweig | |
| 4,096,590 A | | 6/1978 | Keshock | |
| 4,999,851 A | * | 3/1991 | Hall | 2/175.5 |
| 5,657,490 A | * | 8/1997 | Edmark | 2/182.1 |

FOREIGN PATENT DOCUMENTS

| | | |
|---|---|---|
| DE | 86 19 760.6 | 12/1986 |
| EP | 0 498 562 A1 | 8/1992 |

* cited by examiner

*Primary Examiner*—Bibhu Mohanty
(74) *Attorney, Agent, or Firm*—Kirschstein et al.

(57) ABSTRACT

To prevent a top panel of a crown of a collapsible hat from being crushed and creased, first portions of a frame member extending along a periphery of a brim of the hat are folded to overlap an exterior side of the top panel, and second portions of the frame member are folded to overlap an interior side of the top panel. The frame portions maintain a neat appearance for the top panel even after the hat has been repeatedly collapsed.

1 Claim, 2 Drawing Sheets

FIG. 1
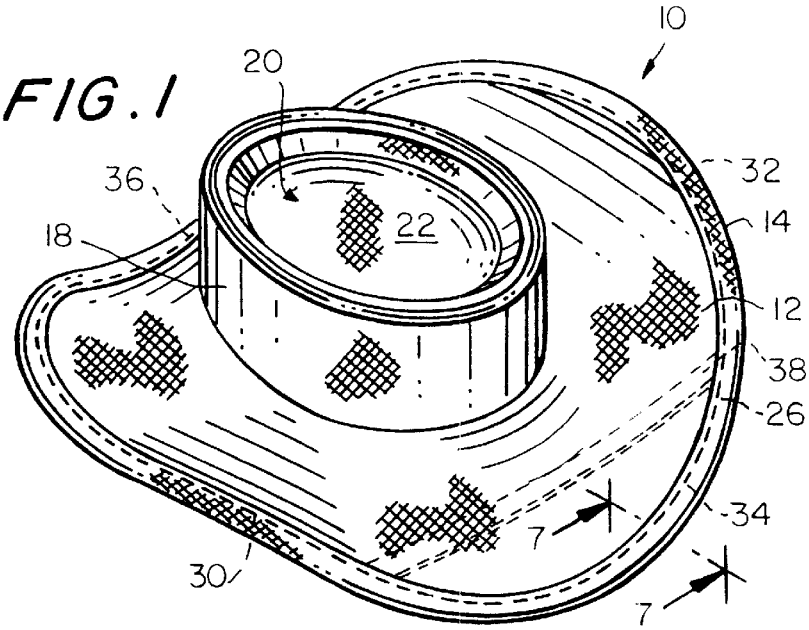
FIG. 2
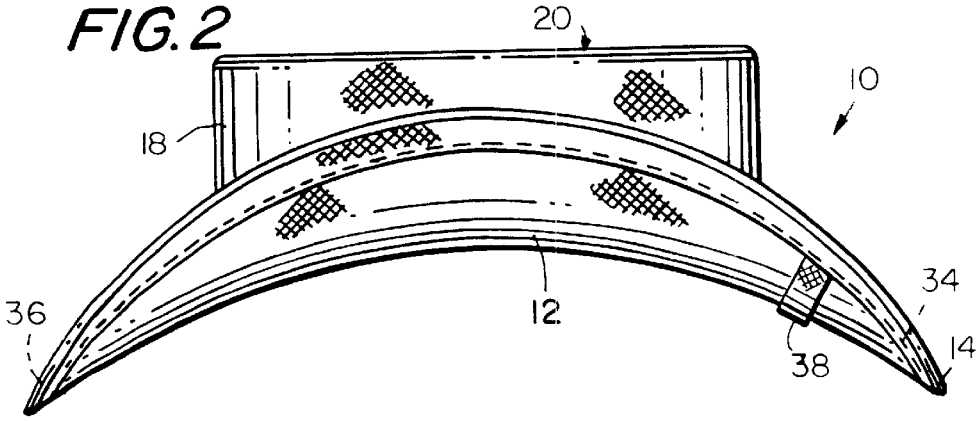
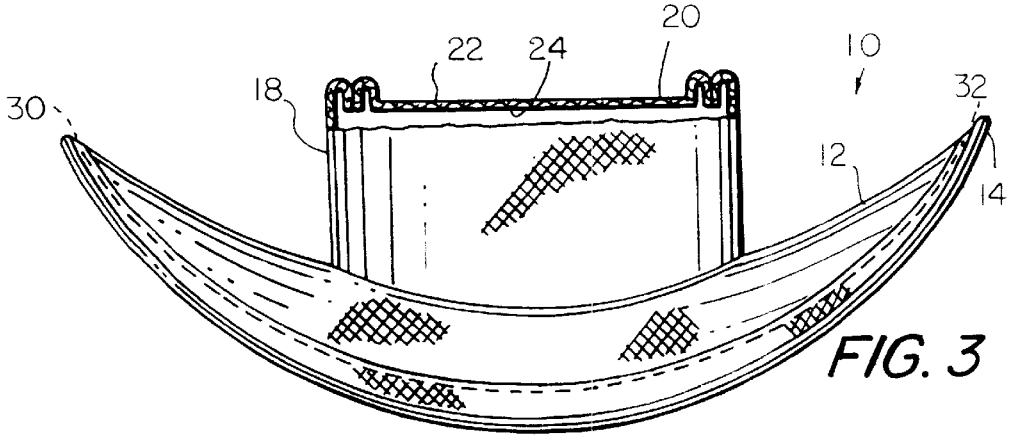
FIG. 3

FIG. 4
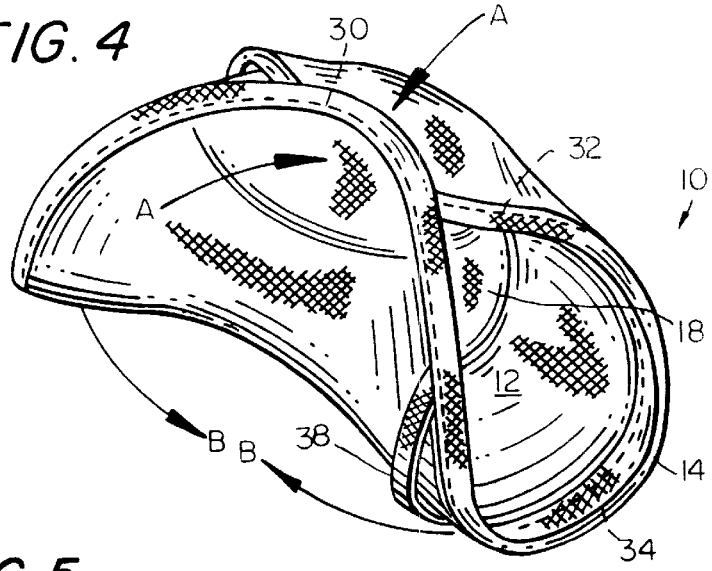
FIG. 5
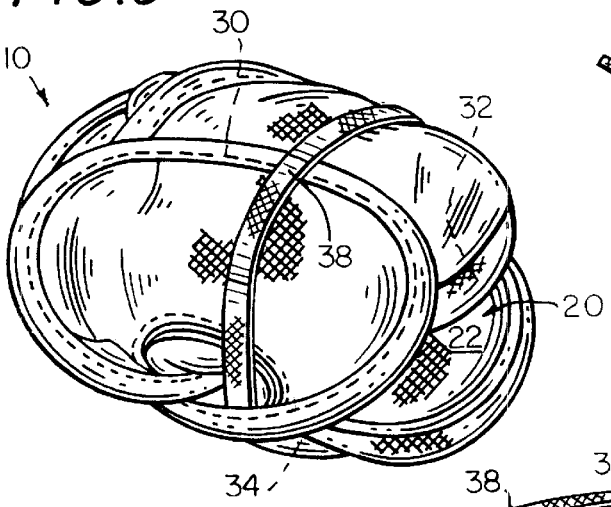
FIG. 8
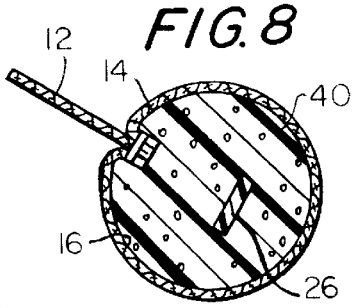
FIG. 6
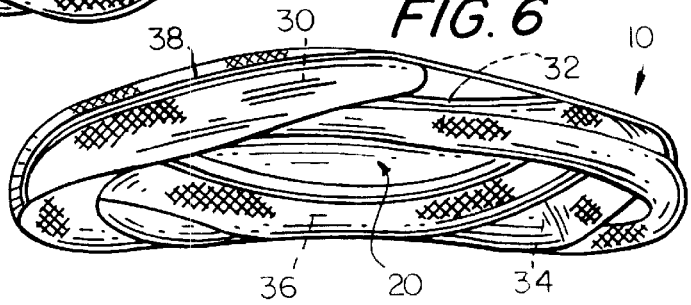
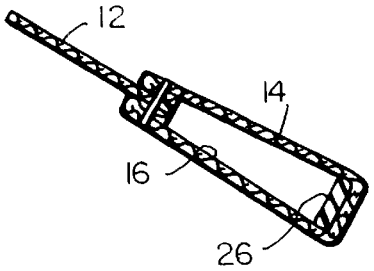
FIG. 7

COLLAPSIBLE HAT AND METHOD OF COLLAPSING THE HAT

This is a continuation of application No. 09/267,822, filed Mar. 12, 1999, now 6,216,277.

BACKGROUND OF THE INVENTION

1. Field of the Invention

This invention generally relates to collapsible hats and to a method of collapsing the hat without crushing a top panel of a crown of the hat.

2. Description of the Related Art

Collapsible hats are readily foldable to a relatively small, compact size rendering the folded hat easy to store in one's pocket or purse and simple to transport from place to place. Such collapsible hats are often provided with wide brims and are especially useful as informal headwear such as sunhats, rainhats and sports hats. U.S. Pat. Nos. 480,041; 2,149,468; 2,495,041; 2,686,917; 4,096,590; 4,682,373; and 4,999,851 are exemplificative of such collapsible hats and methods of folding them.

Such collapsible hats are often provided with a metal wire or hoop in the outer periphery of the hat brim to impart a shape to the hat when worn. To collapse the hat, this hoop is twisted in a direction which folds and crushes a top panel of a crown of the hat. Repeated crushing of the top crown panel imparts a rumpled, worn look to the crown and detracts from the overall appearance of the hat when worn. The hoop does not serve to restore the crown to its original, unrumpled shape. Despite the informal nature of such hats, many wearers will not choose to wear hats having wrinkled and creased areas.

SUMMARY OF THE INVENTION

OBJECTS OF THE INVENTION

Accordingly, it is a general object of this invention to provide a collapsible hat which is substantially unwrinkled and uncreased when worn.

More particularly, it is an object of the present invention to provide a novel hat which is conveniently foldable to a compact size and volume for easy transport and storage.

Still another object of the present invention is to provide a novel hat which is easily unfoldable to a head-covering, use condition.

It is yet another object of the present invention to provide a novel method of collapsing and folding the hat without crushing a top panel of a crown of the hat.

A still further object of the present invention is to provide a hat which is durable in construction, easy to maintain, and long-lived in use, without sacrificing a pleasing appearance for the hat.

FEATURES OF THE INVENTION

In keeping with these objects and others which will become apparent hereinafter, one feature of this invention resides, briefly stated, in a collapsible hat and in a method of collapsing and folding the hat between a collapsed, compact storage condition and a head-covering, use condition. The hat comprises a flexible brim having a generally annular shape in the use condition and having a compartment extending along an outer periphery of the brim, and a crown including a top panel having an exterior side and an interior side, and a collapsible, generally annular crown panel extending between the top panel and the brim. A frame member is received in the compartment, and has a predetermined, generally annular shape in the use condition in which the frame member shapes the brim. The frame member has first frame portions opposite each other, and second frame portions opposite each other and angularly spaced away from the first frame portions.

In accordance with one feature of this invention, the first frame portions are foldable to overlap the exterior side of the top panel in the collapsed condition, and the second frame portions are foldable to overlap the interior side of the top panel in the collapsed condition. Both the first and second frame portions protect the top panel from being folded and crushed in the collapsed condition, thereby enabling the top panel to maintain an uncreased, unwrinkled and unrumpled appearance when the hat is worn.

In a preferred embodiment, the brim and the crown are constituted of a fabric material, such as cloth, and the frame member is constituted of a resilient material, such as metal. The top panel has a generally circular shape and is stitched along a generally circular first seam to an upper region of the crown panel. The brim is stitched along a generally circular, second seam to a lower region of the crown panel.

Another advantageous feature resides in providing a binding strip stitched along the outer periphery of the brim. The strip bounds the compartment with the brim. The frame member is received within the compartment with clearance. Thus, it is the predetermined shape of the frame member that dictates the shape of the brim. The frame member can also be encased in a soft, flexible, cylindrical foam sleeve which fills out the compartment and provides a cushioned peripheral compartment.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a collapsible hat according to this invention in the use condition;

FIG. 2 is a side elevational view of the hat;

FIG. 3 is a front elevational view of the hat with an upper broken-away portion of the crown shown in section;

FIG. 4 is a perspective of the hat of FIG. 1 during a first stage of folding according to this invention;

FIG. 5 is a perspective view of the hat in the collapsed condition;

FIG. 6 is a side elevational view of the hat in the collapsed condition;

FIG. 7 is an enlarged sectional view taken on line 7—7 of FIG. 1; and FIG. 8 is a view analogous to FIG. 7, but of another embodiment.

DETAILED DESCRIPTION OF THE PREFERRED EMBODIMENTS

Referring now to the drawings, reference numeral 10 generally identifies a hat collapsible, in accordance with the method of this invention, between a collapsed, compact storage condition, as shown in FIG. 5, and a head-covering, use condition, as shown in FIG. 1.

Hat 10 includes a flexible brim 12 having a generally annular shape in the use condition and constituted of a thin, pliant sheet material, for example, a fabric material such as cloth. A synthetic resinous material, such as polyester or nylon, is desirable. The brim 12 has a generally circular outer periphery about which a binding strip 14 (see FIG. 7) is wrapped and stitched to form an internal, annular compartment 16.

Hat 10 further includes a crown including a collapsible, generally annular crown panel 18 stitched along a lower circular region to a generally circular inner periphery of the brim 12, and a generally circular top panel 20 stitched about its periphery to an upper circular region of the crown panel 18. The top panel 20 has an exterior or outwardly facing upper side 22 and an opposite, interior or inwardly facing lower side 24 (see FIG. 3).

A frame member 26 (see FIG. 7) is received in the compartment 16 and has a predetermined, generally annular shape in order to impart its shape to the brim. Preferably, the frame member 26 is constituted of a resilient material, such as metal or synthetic plastic, that is capable of returning to an initial position after having been folded, twisted or otherwise subjected to stress.

The frame member 26 can be molded into the annular shape or can be fashioned into the annular shape by, in the case of a metal wire, welding the opposite wire ends together to form a hoop. The binding strip 14 is wrapped around the hoop and, thereupon, the overlapping free ends of the strip 14 are stitched to an outer peripheral margin of the brim. The hoop can have any three-dimensional shape, such as a sinuous form having many curved crests and valleys alternating with one another, or a scalloped configuration or, as previously stated, any shape whatsoever. Whatever shape is chosen for the frame member dictates the shape to be imparted to the brim since the material of the brim will follow the shape of the frame member.

As shown in FIG. 8, a soft, flexible, cylindrical sleeve 40 encases the frame member 26 in another embodiment. The sleeve 40 more completely fills the compartment and imparts its shape thereto. The sleeve 40 provides a soft, cushioned, peripheral zone around the brim.

As best shown in FIG. 1, the frame member 26 has a pair of first frame portions 30, 32, diametrically opposite each other, and a pair of second frame portions 34, 36 diametrically opposite each other, and angularly offset from the first frame portions. In use, the first frame portions 30, 32 are located at opposite sides of the wearer's head, i.e., above the ears, while the second frame portions are spaced 90° apart and are located at the front and back of the wearer's head.

In order to fold the hat, one of the pair of frame portions, for example, the first portions 30, 32, as shown in FIG. 4, are individually and successively folded in the direction of arrows A into an overlapping relation with each other and with one of the sides of the top panel, for example, the upper side 22. Then, the second portions 34, 36 are individually and successively folded in the direction of arrows B into an overlapping relation with each other and with the other of the sides of the top panel, for example, the lower side 24. Both the overlapped first portions and the overlapped second portions protect the top panel 20, as shown in FIGS. 5 and 6, from being folded, crushed or otherwise creased. This maintains a neat, unrumpled look for the top panel and the hat as a whole, no matter how many frames the hat is collapsed and carried in one's pocket or purse.

The collapsed hat is self-maintaining in the collapsed condition. The first and second frame portions form overlying, generally concentric coils which tend to stay in position on both sides of the top panel. Nevertheless, the collapsed hat may conveniently be inserted into a non-illustrated carrying pouch, preferably with a zipper-or Velcro™-type closure. Also, Velcro™ strips of fastening tape may be provided at convenient, inconspicuous locations on the underside of the brim so that the overlapping first frame portions detachably engage each other, and the overlapping second frame portions detachably engage each other, thereby holding all the portions together in a compact package.

It is currently preferred to fixedly secure opposite ends of an elastic strap 38 to the underside of the hat, for example, underneath the brim adjacent one of the frame portions, for example, second portion 34. The strap 38 is normally held taut against the underside of the brim. Once the hat is collapsed to the collapsed condition, the strap 38 is pulled around the overlying coils, thereby holding all the frame portions together. In another embodiment, the strap 38 can be secured to the underside of the top panel 22. The strap 38 has sufficient elasticity to enable the strap 38 to be pulled away form the underside of the brim until the strap 38 engages underneath the wearer's chin, thereby serving as a chin strap in the use condition.

It will be understood that each of the elements described above, or two or more together, also may find a useful application in other types of constructions differing from the types described above.

While the invention has been illustrated and described as embodied in a collapsible hat and the method of collapsing the hat, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. In combination, a) a hat having a brim and an annular compartment extending around an outer periphery of the brim; and b) a pre-shaped frame member for shaping the brim of the hat collapsible between a collapsed, compact storage condition and a head-covering, use condition, the frame member constituting a three-dimensional element having a predetermined, generally annular shape received with clearance in the annular compartment, said element being constituted of a resilient material to return by its own inherent resilience to said annular shape to shape the brim in the use condition.

* * * * *